US005703036A

United States Patent [19]

Iakovides

[11] Patent Number: 5,703,036

[45] Date of Patent: Dec. 30, 1997

[54] THICKENED AQUEOUS DETERGENT COMPOSITIONS WITH IMPROVED CLEANING PERFORMANCE

[75] Inventor: Panos Iakovides, Rome, Italy

[73] Assignee: The Procter & Gamble Company, Cincinnati, Ohio

[21] Appl. No.: 617,773

[22] PCT Filed: Sep. 12, 1994

[86] PCT No.: PCT/US94/10199

§ 371 Date: Mar. 19, 1996

§ 102(e) Date: Mar. 19, 1996

[87] PCT Pub. No.: WO95/08611

PCT Pub. Date: Mar. 30, 1995

[30] Foreign Application Priority Data

Sep. 20, 1993 [EP] European Pat. Off. ..... 93870191

[51] Int. Cl.[6] ..... C11D 1/14; C11D 1/75; C11D 1/83

[52] U.S. Cl. ..... 510/427; 510/221; 510/228; 510/237; 510/428; 510/433; 510/496; 510/503

[58] Field of Search ..... 510/191, 221, 510/228, 237, 427, 433, 495, 503, 496, 428

[56] References Cited

U.S. PATENT DOCUMENTS

| | | | |
|---|---|---|---|
| 3,996,149 | 12/1976 | Burke, Jr. | 252/160 |
| 4,071,463 | 1/1978 | Steinhauer | 252/103 |
| 4,272,395 | 6/1981 | Wright | 252/106 |
| 4,282,109 | 8/1981 | Citrone et al. | 252/102 |
| 4,839,077 | 6/1989 | Cramer et al. | 252/98 |
| 5,055,219 | 10/1991 | Smith | 252/102 |
| 5,531,915 | 7/1996 | Perkins | 510/294 |
| 5,549,842 | 8/1996 | Chang | 510/191 |

*Primary Examiner*—Paul Lieberman
*Assistant Examiner*—John R. Hardee
*Attorney, Agent, or Firm*—Robert B. Aylor; T. David Reed

[57] ABSTRACT

The compositions of the present invention have a viscosity of from 40 cps to 4000 cps; comprising a viscosity-decreasing short chain surfactant, said surfactant comprising a hydrophobic portion and a hydrophilic portion, wherein the chain length of the hydrophobic portion is $C_6$ to $C_{10}$.

The composition also comprises a viscosity restoring long chain surfactant mixture. Said mixture comprises an amine oxide according to the formula $R_1R_2R_3NO$, wherein $R_1$ is a linear $C_{12}$ to $C_{16}$ alkyl group and $R_2$ and $R_3$ are independently $C_1$ to $C_3$ alkyl groups and an alkali metal alkyl sulphate according to the formula $R_4OSO_3M$, wherein $R_4$ is a $C_{12}$ to $C_{14}$ alkyl group and M is an alkali metal. The compositions also preferably comprise hypochlorite.

10 Claims, No Drawings

THICKENED AQUEOUS DETERGENT COMPOSITIONS WITH IMPROVED CLEANING PERFORMANCE

TECHNICAL FIELD

The present invention relates to thickened aqueous detergent compositions.

BACKGROUND OF THE INVENTION

Liquid detergent compositions comprising long chain surfactants such as amine oxides are well known in the art. Such compositions are typically those as in U.S. Pat. No. 4,282,109, EP 274 885, EP 233 666, DE 28 37 880 and EP 30 401.

It is desirable that such compositions have good cleaning properties. However, it has been found that long chain amine oxides do not provide the optimum cleaning performance. It is a first object of the present invention to provide cleaning compositions comprising long chain surfactants with improved cleaning.

In response to this object, it has been found that the incorporation of short chain surfactants is beneficial and meets this object thereby enhancing the cleaning performance.

However, it has been observed that the incorporation of short chain surfactants at amounts needed to enhance performance in such compositions results in the decrease of viscosity of the composition. Yet, it is considered essential that the compositions should exhibit a high degree of viscosity so that the compositions adhere to the vertical surfaces and surfaces inclined to the horizontal.

Thus, it is a further object of the present invention to provide a liquid composition which comprises long chain surfactants and short chain surfactants, which retains viscosity.

In response to this object, it has been found that viscosity may be retained even upon the addition of short chain surfactants, by the use of a mixture of amine oxide and alkyl sulphate, more specifically a mixture of a $C_{12}$–$C_{16}$ chain amine oxide and a $C_{12}$–$C_{14}$ alkyl sulphate.

A further advantage of the present invention is that there is no need for an additional thickening agent.

Thickening compositions comprising long chain surfactants are well known in the art.

U.S. Pat. No. 4,282,109 discloses a thickened bleach composition comprising hypochlorite and a thickening amount of a surfactant blend, comprising amine oxide $C_{10}$–$C_{18}$ and alkyl sulphate $C_8$–$C_{12}$ at a ratio of 3:4 or more.

EP 274 885 discloses thickened bleaching compositions comprising alkali metal hypochlorite and straight chain $C_{14}$ amine oxide with a mixture of branched and straight chain $C_{15}$ amine oxides. There is no mention of short chain surfactants.

EP 233 666 discloses a process for the manufacture of a thickened bleaching compositions comprising hypochlorite, a hypochlorite-soluble surfactant and an alkali metal salt of a fatty acid. The detergent actives include amine oxides, preferably lauryldimethylamine.

DE 28 37 880 covers bleaching compositions comprising alkali metal hypochlorite and mixtures of branched and linear amine oxides of varying chain length, ($C_5$–$C_{17}$) for increased viscosity. There is no mention of other long or short chain surfactants.

EP 30 401 covers thickened bleaching compositions comprising hypochlorite and a certain number of product characteristics including pH and viscosity. Mixtures of $C_8$–$C_{18}$ amine oxides and fatty acids are preferred as thickening agents. No other surfactants are disclosed.

SUMMARY OF THE INVENTION

The compositions of the present invention have a viscosity of from 40 cps to 4000 cps; comprising a viscosity-decreasing short chain surfactant, said surfactant comprising a hydrophobic portion and a hydrophilic portion, wherein the chain length of the hydrophobic portion is $C_6$ to $C_{10}$.

The composition also comprises a viscosity restoring long chain surfactant mixture. Said mixture comprises an amine oxide according to the formula $R_1R_2R_3NO$, wherein $R_1$ is a linear $C_{12}$ to $C_{16}$ alkyl group and $R_2$ and $R_3$ are independently $C_1$ to $C_3$ alkyl groups and an alkali metal alkyl sulphate according to the formula $R_4OSO_3M$, wherein $R_4$ is a $C_{12}$ to $C_{14}$ alkyl group and M is an alkali metal. The compositions also preferably comprise hypochlorite.

All ratios, percentages and parts given herein are by % weight of the total composition unless otherwise specified.

DETAILED DESCRIPTION OF THE INVENTION

1. Short Chain Surfactant

The compositions according to the present invention comprise a short chain surfactant. Said surfactant comprises a hydrophobic portion and a hydrophilic portion, wherein the chain length of the hydrophobic portion is $C_6$ to $C_{10}$. It has been found that the cleaning performance of the composition according to the present invention can be boosted by the incorporation of said short chain surfactant.

All surfactants have in common that they comprise a hydrophobic portion and a hydrophilic portion. By short chain surfactant, it is meant herein surfactants which comprise a $C_6$–$C_{10}$ alkyl chain as their hydrophobic portion. Such short chain surfactants are accordingly those conventionally used in this field, but with a shorter alkyl chain, and can be of any type. Accordingly, suitable short chain surfactants for use herein include $C_6$–$C_{10}$ alkyl sulfates ($C_6$–$C_{10}SO_4$), alkyl ether sulfates ($C_6$–$C_{10}(OCH_2CH_2)eSO_4$), alkyl sulphonates ($C_6$–$C_{10}SO_3$), alkyl succinates ($C_6C_{10}OOCCH_2CH_2COOZ$), alkyl carboxylates ($C_6$–$C_{10}COOM$), alkyl ether carboxylates ($C_6$–$C_{10}(OCH_2CH_2)_eCOOM$), alkyl sarcosinates ($C_6$–$C_{10}CON(CH_3)R$), alkyl sulpho succinates ($C_6$–$C_{10}OOCCH(SO_3M)CH_2COOZ$), amine oxides ($C_6$–$C_{10}RR'NO$), and betaines ($C_6$–$C_{10}N^+(CH_3)_2CH_2COO$—). In the formulae in brackets, e is from 0 to 20, Z is M or R, M is H or any counterion such as those known in the art, including Na, K, Li, $NH_4$, amine, R and R' are $C_1$–$C_5$ alkyl groups, possibly functionalized with hydroxyl groups, R and R' are preferably $C_1$–$C_3$, most preferably methyl. All these surfactants are well known in the art. The compositions according to the present invention may comprise any of the above surfactants alone, or any combination thereof, depending on the end use envisioned.

Preferred short chain anionic surfactants for use herein are $C_6$–$C_{10}$ alkyl sulfates ($C_6$–$C_{10}SO4$) and alkyl sulphonates ($C_6$–$C_{10}SO_3$). Most preferred are the C6–C8 alkyl sulfates and sulphonates. Such short chain anionic surfactants can be made by well known sulphation or sulphonation processes followed by neutralization, but said anionic short chain surfactants are more conveniently commercially available, for instance from Rhone Poulenc under the trade name Rhodapon®OLS, or from Witco under the trade name Witconate®.

Preferred short chain surfactants for use herein is octyl sulphate. Suitable short chain surfactants for use herein are preferably hypochlorite compatible. According to the present invention, the compositions comprise from 1% to 5% preferably from 2% to 4%, of short chain surfactants.

It has been observed that the incorporation of short chain surfactants in compositions comprising typical amine oxides described in the art results in the decrease of said compositions viscosity. It has now been found that the viscosity of the compositions is restored by the use of a mixture of a $C_{12}$ to $C_{14}$ chain amine oxide and a $C_{12}$ to $C_{14}$ chain alkyl sulphate.

2.Long Chain Surfactant Mixture a. Long Chain Amine Oxides

Suitable amine oxides for use herein comprise amine oxides according to the formula $R_1R_2R_3NO$, wherein $R_1$ is a linear $C_{12}$ to $C_{16}$ alkyl group, and $R_2$ and $R_3$ are independently $C_1$ to $C_3$ alkyl groups, preferably methyl and mixtures thereof.

Suitable long chain amine oxides for use herein can be $C_{14}$ amine oxide Genaminox$^R$ MY—X, (available from Hoechst) $C_{12}$ and $C_{14}$ amine oxide Aromox$^R$ DMMCD-W, (AKZO), and $C_{14}$ amine oxide Aromox DM14D-W, (AKZO). However, preferred for use herein are $C_{16}$ amine oxides, and mixtures of $C_{16}$ and $C_{14}$ amine oxides, which offer better suds profile, i.e. produce less foam. Suitable $C_{16}$ amine oxides are commercially available under the trade name Genaminox CE. According to the present invention, said compositions comprise from 1% to 6%, preferably from 2% to 5%, more preferably from 3% to 4% of said $C_{12}$ to $C_{14}$ amine oxide.

b. Long Chain Alkyl Sulphates

Suitable alkyl sulphates for use herein comprise alkyl sulphates according to the formula $R_4OSO_3M$, wherein $R_4$ is a $C_{12}$ to $C_{14}$ alkyl group and mixtures thereof. M is an alkali metal. Preferred alkyl sulphates for use herein can be sodium dodecyl sulphate or sodium lauryl sulphate.

Compositions according to the present invention comprise from 1% to 4%, preferably from 2% to 3% by weight of the total compositions of said long chain alkyl sulphate. Suitable long chain surfactants for use herein are preferably hypochlorite compatible.

According to the present invention the ratio of the amine oxide to the total amount of $C_{12}$–$C_{14}$ alkyl sulphate and short chain alkyl sulphate is less than 3:4, preferably less than 4:6.

According the present invention the compositions have a viscosity from 40 cps to 4000 cps, preferably from 100 cps to 2000 cps, most preferably from 150 cps to 600 cps, measured with a Brookfield viscosimeter RVT at a temperature of 25° C. using spindle numbers 1 to 4 at 20–100 r.p.m.

The compositions according to the present invention may comprise a number of optional ingredients. A highly preferred optional ingredient according to the present invention is a hypochlorite bleaching agent, preferably an alkali metal hypochlorite. Although alkali metal hypochlorites are preferred other hypochlorite compounds may also be used herein and can be selected from calcium and magnesium hypochlorite. Preferred alkali metal hypochlorite for use herein is sodium hypochlorite. Compositions according to the present invention comprise said hypochlorite bleaching agents such that the content of active chlorine in the compositions is from 0.4% to 4%, preferably from 1% to 2%. According to the present invention the ingredients of the compositions are selected so that the compositions are hypochlorite compatible.

An optional requirement of the compositions according to the present invention is that the pH is greater than 10, preferably greater than 11, more preferably greater than 12. This is achieved by the addition of from 0.4% to 2% of a caustic alkali. Suitable caustic alkalis for use herein include sodium and potassium hydroxide. Compositions according to the present invention comprising hypochlorite preferably have a pH greater than 12 for hypochlorite stability.

Another optional component of the present invention is an alkali metal salt of a $C_8$–$C_{18}$ fatty acid. Said fatty acids are used as suds suppressors. Suitable fatty acids for use herein can be any $C_8$–$C_{18}$ fatty acid, preferably fully saturated, preferably a sodium, potassium or lithium salt, more preferably the sodium salt. Suitable fatty acids may be selected from caprylic acid, capric acid, lauric acid, myristic acid, palmitic acid, stearic acid and mixtures of fatty acids suitably hardened, derived from natural sources such as tallow, coconut oil, ground oil and babassu oil.

Compositions according to the present invention comprise from 0.1% to 2%, preferably from 0.5% to 1% by weight of the composition of fatty acids.

The detergent compositions herein may additionally comprise as an optional ingredient an organic surface-active agent selected from anionic, nonionic, cationic and zwitterionic surface-active agents and mixtures thereof.

The compositions according to the present invention may also comprise a number of additional ingredients such as colourants and perfumes. Additionally, the compositions according to the present invention may comprise silicates used as corrosion inhibitors and silicones as suds suppressors. The compositions according to the present invention are preferably aqueous and comprise from 80% to 95%, more preferably from 85% to 90% of water.

The compositions according to the present invention are prepared by methods well known in the art such as the methods described in GB 1 329 086. The compositions according to the present invention can be prepared by mixing all of the ingredients in a non-metallic apparatus at room temperature or in warm water. If fatty acid is used, it is melted before being added to the mixture. Preferably, the surfactant blend is first prepared by adding the short chain surfactant to the long chain components. Perfume and the alkali metal hypochlorite are then added whilst stirring. Colourants are added after all the other ingredients have been mixed.

The compositions of the present invention may be used for a variety of cleaning purposes such as cleaning hard surfaces whereby said compositions thickened nature results in longer adhesion to the surface than non-thickened compositions.

The compositions according to the present invention can be illustrated by the following examples.

EXAMPLES

| Ingredients | 1 | 2 | 3 | 4 | 5 |
|---|---|---|---|---|---|
| octyl sulphate | 3 | 3 | 3 | 4 | 3 |
| $C_{12}$ amine oxide | — | 3.2 | — | — | — |
| $C_{14}$ amine oxide | 3 | — | 3 | 4 | 3 |
| $C_{12}$ alkyl sulphate | 2 | 3 | 3 | 2 | 3.5 |
| coconut fatty acid | 0.9 | 0.9 | 0.9 | 0.9 | 0.9 |
| sodium hypochlorite | 1.6 | 1.6 | 1.6 | 1.6 | 1.6 |
| sodium hydroxide | | | | | |
| minors and water | | | | | |
| viscosity | 100 | 110 | 165 | 170 | 185 |

| Ingredients | 6 | 7 | 8 | 9 | 10 |
|---|---|---|---|---|---|
| octyl sulphate | 2 | 2 | 3 | 2 | 3 |

-continued

| EXAMPLES | | | | | |
|---|---|---|---|---|---|
| $C_{12}$ amine oxide | — | — | — | — | — |
| $C_{14}$ amine oxide | 2.4 | 2.4 | 3.2 | 2.4 | 4 |
| $C_{12}$ alkyl sulphate | 2 | 2 | 3 | 2 | 3 |
| coconut fatty acid | 0.9 | — | 0.9 | 0.9 | 0.9 |
| sodium hypochlorite | 1.6 | 1.6 | 1.6 | 1.6 | 1.6 |
| sodium hydroxide | | | | | |
| minors and water | | | | | |
| viscosity | 215 | 230 | 250 | 280 | 3820 |

| Ingredients | 11 | 12 | 13 | 14 | 15 | 16 |
|---|---|---|---|---|---|---|
| octyl sulphate | 3 | 3 | 3 | 3 | 3 | 3 |
| $C_{14}$ amine oxide | 3 | 3 | 3 | 3 | 1.6 | 1.5 |
| $C_{16}$ amine oxide | — | — | — | — | 1.5 | 1.4 |
| lauryl sulphate | 1.5 | 1.5 | 1.5 | 1.5 | 1.2 | 1.5 |
| palm kernel fatty acid | 0.8 | 0.8 | 0.8 | 0.8 | 0.5 | — |
| coconut fatty acid | — | — | — | — | — | 0.7 |
| sodium hypochlorite | 2 | 3 | 4 | 5 | 1.65 | 1.5 |
| sodium hydroxide | 1.3 | 1.3 | 1.3 | 1.3 | 1.0 | 1.1 |
| silicate | 0.4 | 0.4 | 0.4 | 0.4 | — | — |
| perfume | 0.3 | 0.3 | 0.3 | 0.3 | 0.3 | 0.2 |
| water and minors | | | | | | |
| viscosity | 150 | 350 | 560 | 600 | 300 | 350 |

What is claimed is:

1. A detergent composition having a viscosity of from 215 cps to 4000 cps comprising;

from 1 to 5% of a viscosity decreasing short chain surfactant, said surfactant comprising a hydrophobic portion and a hydrophilic portion, wherein the chain length of said hydrophobic portion is $C_6$ to $C_{10}$, said short chain surfactants being selected from the group consisting of alkyl sulfates, alkyl ether sulfates, alkyl sulfonates, alkyl succinates, alkyl carboxylates, alkyl sarcosinates, alkyl sulfosuccinates, amine oxides and betaines, and a viscosity restoring long chain surfactant mixture, said mixture comprising:

from 1 to 5% of an amine oxide according to the formula $R_1R_2R_3NO$, wherein $R_1$ is a linear $C_{12}$ to $C_{16}$ alkyl group and $R_2$ and $R_3$ are independently $C_1$ to $C_3$ alkyl groups, and from 1 to 4% of an alkali metal alkyl sulphate according to the formula $R_4OSO_3M$, wherein $R_4$ is a $C_{12}$ to $C_{14}$ alkyl group and M is an alkali metal, and wherein the ratio of said $C_{12}$ to $C_{16}$ amine oxide to the total amount of said $C_{12}$ to $C_{14}$ alkyl sulfate is less than 2:3.

2. A detergent composition according to claim 1, wherein said short chain surfactant is an alkyl sulphate.

3. A detergent composition according to claim 1, comprising from 2% to 5% of said long chain $C_{12}$ to $C_{16}$ amine oxide.

4. A detergent composition according to claim 1, wherein said $C_{12}$–$C_{16}$ amine oxide is a dimethyl amine oxide.

5. A detergent composition according to claim 1, wherein said amine oxide is a mixture of $C_{14}$ and $C_{16}$ amine oxides.

6. A detergent composition according to claim 1 wherein the said alkali metal sulphate is sodium lauryl sulphate.

7. A detergent composition according to claim 1, further characterized in that said composition comprises an alkali metal hypochlorite.

8. A detergent composition according to claim 7, comprising from 0.4% to 4% of said hypochlorite.

9. A detergent composition according to claim 7, having a pH of above 10.

10. A detergent composition according to claim 1 wherein said viscosity is from 215 cps to 600 cps.

* * * * *